US008505562B2

(12) United States Patent
McPhee, III

(10) Patent No.: US 8,505,562 B2
(45) Date of Patent: Aug. 13, 2013

(54) HANDS-FREE CLEANING APPARATUS FOR ROLLER PADS AND/OR PAINTBRUSHES

(76) Inventor: William James McPhee, III, Portland, OR (US)

( * ) Notice: Subject to any disclaimer, the term of this patent is extended or adjusted under 35 U.S.C. 154(b) by 522 days.

(21) Appl. No.: 12/786,792

(22) Filed: May 25, 2010

(65) Prior Publication Data

US 2010/0300500 A1 Dec. 2, 2010

Related U.S. Application Data

(60) Provisional application No. 61/182,886, filed on Jun. 1, 2009.

(51) Int. Cl.

| | |
|---|---|
| ***B08B 3/02*** | (2006.01) |
| ***B08B 9/34*** | (2006.01) |
| ***B08B 9/28*** | (2006.01) |
| ***B05B 1/04*** | (2006.01) |
| ***B05B 1/14*** | (2006.01) |
| ***B05B 13/02*** | (2006.01) |

(52) U.S. Cl.

USPC ..... 134/198; 134/86; 134/103.2; 134/137; 134/149; 134/153; 134/157; 134/199; 134/200

(58) Field of Classification Search

USPC ..... 134/86, 103.2, 137, 148–149, 153, 134/157, 198–200

See application file for complete search history.

(56) References Cited

U.S. PATENT DOCUMENTS

| | | | | |
|---|---|---|---|---|
| 2,831,488 | A * | 4/1958 | Anderson | 134/138 |
| 3,075,534 | A * | 1/1963 | Habostad | 134/138 |
| 3,428,060 | A * | 2/1969 | Spivey | 134/141 |
| 3,688,785 | A * | 9/1972 | Stevens et al. | 134/138 |
| 3,886,960 | A * | 6/1975 | Krueger | 134/138 |
| 4,218,265 | A | 8/1980 | Fuchs et al. | |
| 4,299,245 | A | 11/1981 | Clapper | |
| 4,377,175 | A * | 3/1983 | Fritz | 134/138 |
| 4,402,333 | A | 9/1983 | Frizzell et al. | |
| 4,641,673 | A * | 2/1987 | Conley et al. | 134/138 |
| 4,672,987 | A * | 6/1987 | Brandt | 134/138 |
| 4,708,152 | A * | 11/1987 | Hibberd | 134/138 |
| 4,711,258 | A * | 12/1987 | Rossborough et al. | 134/138 |
| 4,733,679 | A | 3/1988 | Dolcater | |
| 4,809,722 | A * | 3/1989 | Pennise | 134/138 |
| 4,832,066 | A * | 5/1989 | Shipman | 134/137 |

(Continued)

OTHER PUBLICATIONS www.handysolutions.uk.com.

(Continued)

*Primary Examiner* — Arlen Soderquist
(74) *Attorney, Agent, or Firm* — Simple IP Law, P.C.

(57) ABSTRACT

A hands-free cleaning apparatus enabling a user to clean various roller pads and/or paintbrushes using a single apparatus. The apparatus includes a main housing and a lid. The housing has a bottom drain hole and legs. An attachment mechanism is provided to receive and retain a roller pad or paintbrush in a desired position within the apparatus. A spraying mechanism is provided within the housing having one or more spray nozzles arranged to spray water (or other cleaning solution) on the pad or brush in a desired spray pattern for spinning and cleaning the pad or brush. In one configuration, each spray nozzle has a spray direction that is slightly offset from other nozzles in relation to the surface of the roller pad or brush being cleaned, helping to force rotation. The spraying mechanism receives water from a hose through a hose attachment.

17 Claims, 4 Drawing Sheets

(56) References Cited

U.S. PATENT DOCUMENTS

| | | | | |
|---|---|---|---|---|
| 5,005,598 | A | 4/1991 | Hodgdon | |
| 5,033,491 | A | 7/1991 | Middleton | |
| 5,050,626 | A | 9/1991 | Brockage et al. | |
| 5,095,928 | A | 3/1992 | Phipps | |
| D330,101 | S | 10/1992 | Weiss | |
| 5,163,459 | A | 11/1992 | Bailey | |
| D340,327 | S | 10/1993 | Alderete | |
| 5,337,769 | A | 8/1994 | Howe | |
| 5,363,869 | A | 11/1994 | McDowell | |
| 5,402,808 | A | 4/1995 | Wallis et al. | |
| 5,409,027 | A | 4/1995 | Glunt | |
| 5,413,133 | A | 5/1995 | Russell | |
| 5,487,399 | A | 1/1996 | Hannah | |
| 5,544,668 | A * | 8/1996 | Dollar | 134/104.2 |
| 5,626,158 | A | 5/1997 | Gratopp | |
| 5,651,381 | A | 7/1997 | Balouchian | |
| 5,839,459 | A | 11/1998 | Bisby | |
| 6,019,111 | A | 2/2000 | Gillies | |
| 6,116,255 | A | 9/2000 | Walter | |
| 6,408,862 | B1 | 6/2002 | van Rooyen | |
| 6,578,590 | B2 * | 6/2003 | Leblond | 134/99.2 |
| 7,383,847 | B2 * | 6/2008 | Clark | 134/148 |
| 7,640,941 | B2 * | 1/2010 | Watters et al. | 134/138 |
| 2002/0166578 | A1 * | 11/2002 | Leblond | 134/99.2 |
| 2004/0003835 | A1 * | 1/2004 | Higgins | 134/138 |
| 2006/0048804 | A1 * | 3/2006 | Walter | 134/198 |
| 2006/0243309 | A1 * | 11/2006 | Prescott et al. | 134/33 |
| 2007/0089765 | A1 * | 4/2007 | Clark | 134/103.2 |
| 2007/0221260 | A1 * | 9/2007 | Watters et al. | 134/149 |
| 2008/0035185 | A1 * | 2/2008 | Baratta | 134/137 |
| 2008/0072932 | A1 * | 3/2008 | Nicholas | 134/34 |
| 2008/0078429 | A1 * | 4/2008 | Hoffmann | 134/178 |
| 2009/0014040 | A1 * | 1/2009 | Leblond | 134/157 |

OTHER PUBLICATIONS www.dulux.co.uk.com.
http://www.jetpro.us/.
http://www.ezrollercleaner.com/.
http://www.paintrifuge.com/.

* cited by examiner

FIG. 3
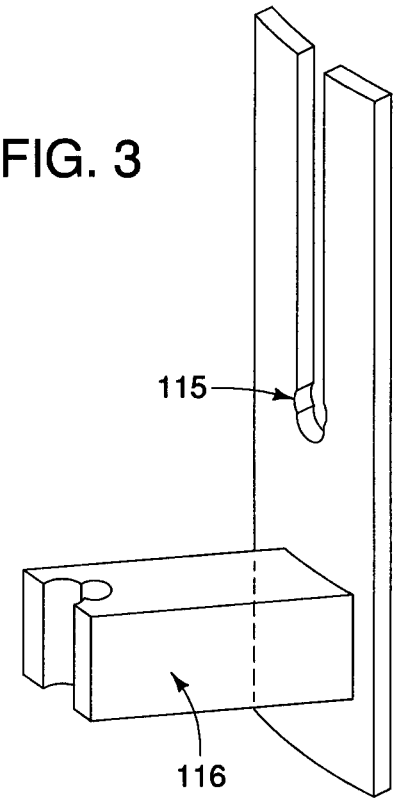
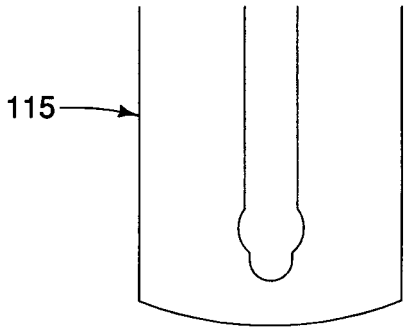
FIG. 3A
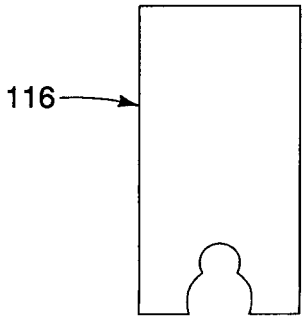
FIG. 3B

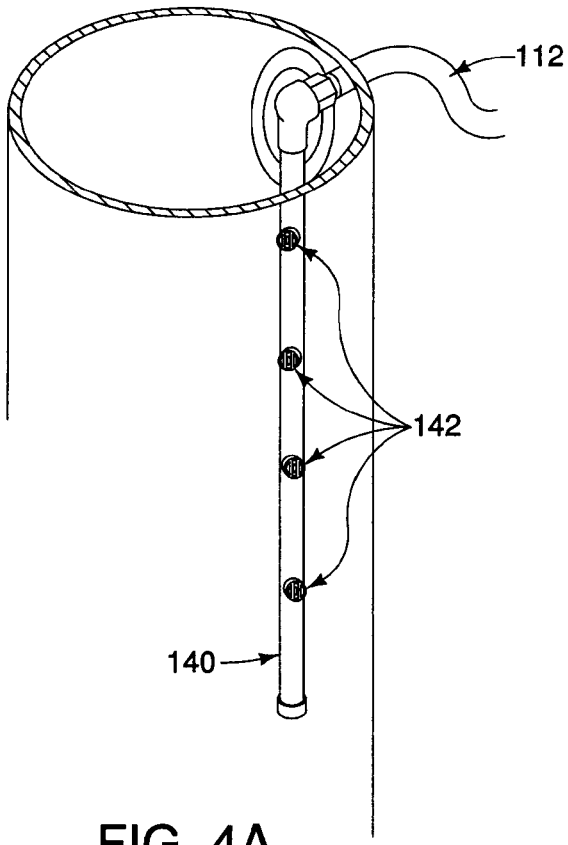
FIG. 4A
FIG. 4C
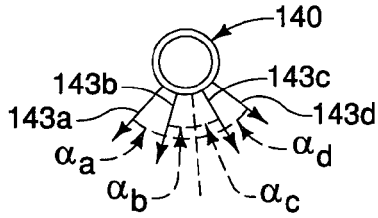
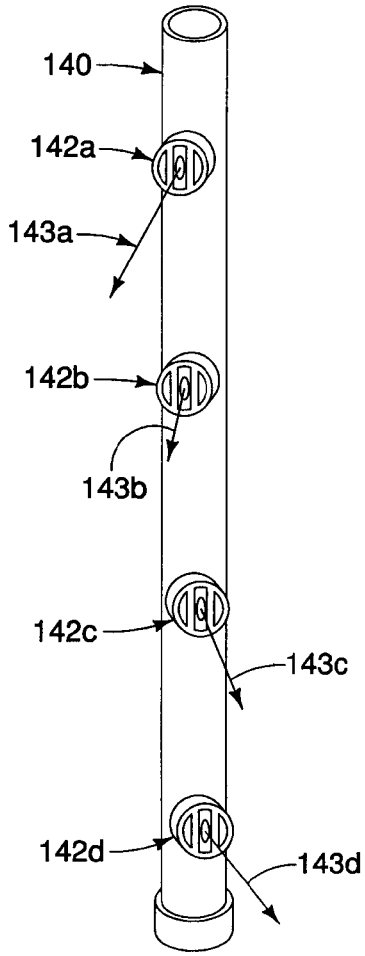
FIG. 4B

HANDS-FREE CLEANING APPARATUS FOR ROLLER PADS AND/OR PAINTBRUSHES

PRIORITY INFORMATION

This application is a nonprovisional of, and claims priority from, U.S. Provisional Patent Application Ser. No. 61/182,886, filed Jun. 1, 2009, the contents of which are incorporated herein by reference in their entirety.

BACKGROUND OF THE INVENTION

1. Field of the invention

This invention relates generally to methods and apparatus for cleaning roller pads and/or paintbrushes. More particularly, this invention relates to a hands-free method and apparatus for cleaning roller pads and/or paintbrushes.

2. Related Art

Various approaches for cleaning roller pads and paintbrushes have been attempted. Some of these are represented, for instance, in U.S. Pat. Nos. 5,839,459; 5,413,133; 5,487,399; 5,626,158; and 5,363,869. Each of these attempts, however, has suffered from one or more drawbacks and has therefore failed to provide an adequate solution to the industry needs.

SUMMARY OF THE INVENTION

The principles of this invention overcome the problems associated with the various prior approaches. In one embodiment of the present invention, a hands-free cleaning apparatus enables the user to clean roller pads of various pad lengths, including, for example: 2.5", 3", 3.5", 4", 9", 12", and 18". Additionally, a second embodiment of the current invention permits cleaning of various smaller size pads, or "mini-roller" pads, having lengths including, for instance, 3", 4",5", and 6".

In an alternative configuration, the apparatus includes a hands-free paintbrush cleaning attachment. This attachment allows the user to clean various sizes of paintbrushes with bristle spans including, for example, 2.5", 3", 3.5" and 4".

According to a preferred embodiment, the cleaning apparatus includes a main housing (preferably a cylinder) and a lid. The lid can include a cradle/clip mechanism that works in conjunction with a connection mechanism to receive and retain a roller pad/brush attachment in the cleaning apparatus. A stem/spraying mechanism having spray nozzles can be arranged longitudinally in the housing to spray water on the pad/brush in a desired manner.

A hose attachment is also preferably provided to allow the user to attach a water supply hose to the apparatus. The bottom of the apparatus preferably includes a drain hole and legs. The hole allows water/paint to be dispensed as the roller pad is being cleaned. The legs allow the apparatus to be retained a desired distance above a supporting surface, thus allowing water/paint to be drained more efficiently.

The lid preferably provides numerous functional elements and also preferably seals with the main housing to contain the water/paint remnants and prevent spillage while the apparatus is working. A handle can be a part of the lid to provide easy portability of the cleaning apparatus. A protrusion/extension can be included as part of the lid to seal off the cradle/clip mechanism and further prevent water seepage, and can also act as a stabilizer for the roller bar(s). The lid is preferably connected to the main housing in a way that provides a secure, sealed connection. To provide this, the lid can, for instance, include a female opening that is a part of the lid, which receives a male stub attached to the housing cylinder. This allows the lid and the cylinder to be joined together securely and function as one unit during operation.

A paintbrush cleaning attachment can also be provided. The paintbrush cleaning attachment can receive a variety of different sizes of paintbrushes and hold them in the cleaning apparatus. When attached in position, water pressure from the stem sprays the brush and causes it to spin. The combination of the spinning and spraying actions serves to effectively clean the brush. The paintbrush attachment can include internal bearings which allow the attachment to spin.

A cradle and a clip can be provided that enable connection of different size roller bars into the cleaning apparatus. For instance, openings of various diameters can be provided in the cradle and clip and can allow the user to install two or more sizes of roller bars into the cleaning apparatus. The openings are also preferably configured to hold the roller bars in a tight press or interference fit to provide stability for the roller pads being cleaned as they receive high water pressure from the stem.

The stem/spraying mechanism is preferably arranged longitudinally in the main housing, which can, for instance, translate into a vertical orientation with respect to the support surface. The stem/spraying mechanism preferably receives water from an attached hose which provides water pressure by forcing water into the stem/spraying mechanism. Tips or nozzles are preferably provided at desired locations along the stem/spraying mechanism to provide a desired spray pattern for cleaning the pads/brushes. The water pressure dispersed from the tips preferably forces the roller pad or paintbrush to spin clean.

In a preferred embodiment, each spray tip is composed of polypropylene and has an opening size encoded "80-15R." This code represents the size of the hole opening and the amount of water being dispersed from that opening. In addition, the openings can create a water fan that sprays an equal amount of water consistently over the span of the roller pad. Furthermore, in one configuration, the spray direction of each spray tip can be slightly offset from one another outwardly in relation to the surface of the roller pad being cleaned, thus helping to force rotation of the brush being cleaned.

Various other aspects, embodiments, and configurations of this invention are also possible without departing from the principles disclosed herein. This invention is therefore not limited to any of the particular aspects, embodiments, or configurations described herein.

BRIEF SUMMARY OF THE DRAWINGS

The foregoing and additional objects and advantages of the present invention will become more readily apparent through the following detailed description, made with reference to the accompanying drawings, in which:

FIG. 3 is a somewhat schematic perspective view of a connection mechanism for receiving and securing a roller brush in the cleaning apparatus of FIG. 1, and FIGS. 3A and 3B are somewhat schematic front and top plan views, respectively, of the connection areas;

FIGS. 4A and 4B are somewhat schematic perspective views of the stem/spraying mechanism, including an enlarged view of the spray nozzles; and FIG. 4C is a schematic top view of the spraying mechanism illustrating various spray directions and spray angles of the spray nozzles.

DETAILED DESCRIPTION OF PREFERRED EMBODIMENTS

According to various principles of the present invention, a hands free cleaning apparatus can be provided for cleaning roller pads, paintbrushes, and/or other painting implements. Numerous embodiments and configurations of the present invention are possible without departing from the core principles of the present invention, each of which will become more apparent through the following detailed description of preferred embodiments.

Figure 1:
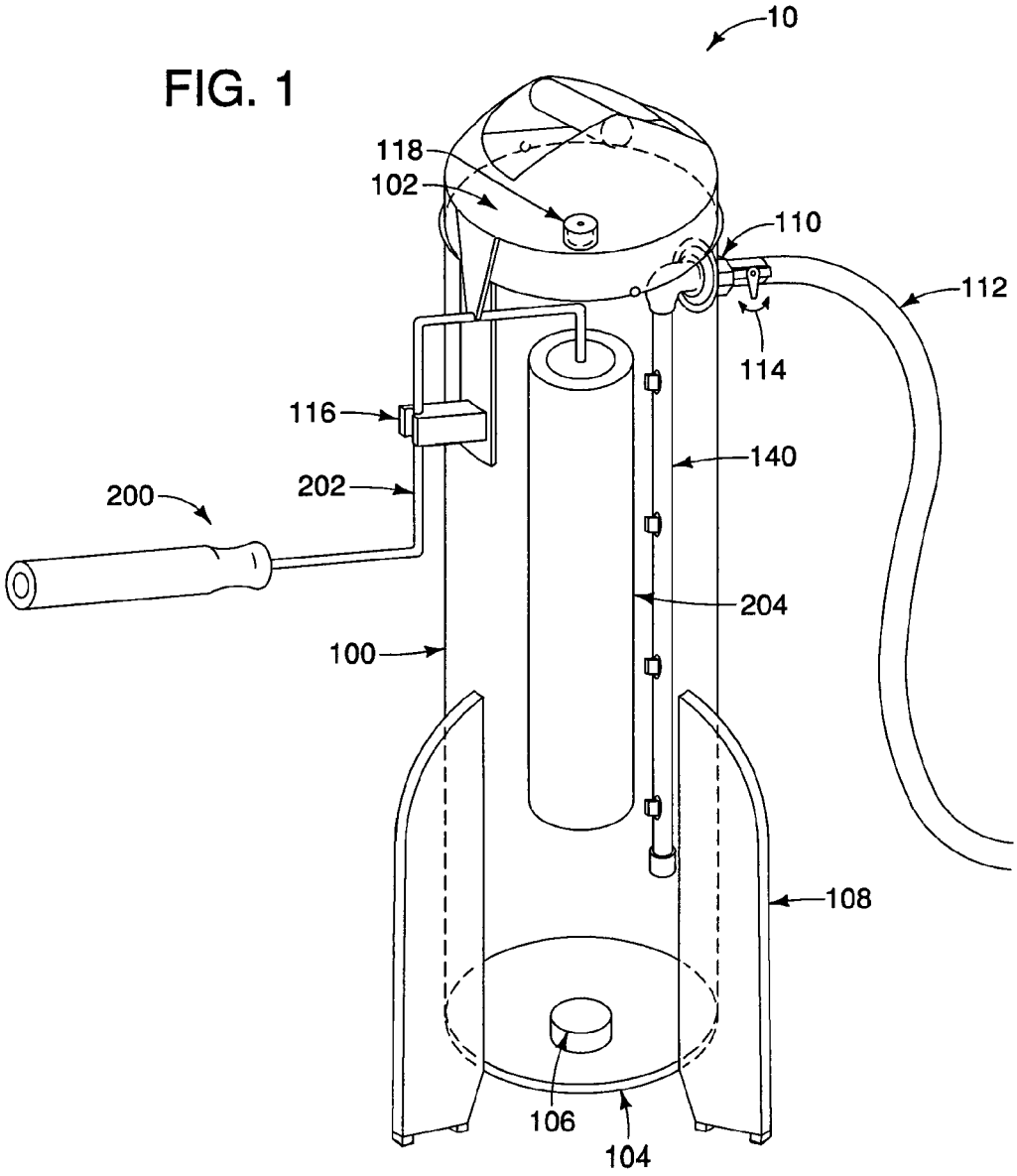
FIG. 1 is a somewhat schematic perspective view of a hands free cleaning apparatus for cleaning roller pads and/or paintbrushes.

FIG. 1 is a somewhat schematic perspective view of a hands-free cleaning apparatus 10 according to one potential embodiment of the present invention. Referring to FIG. 1, a hands-free cleaning apparatus 10 can include a main body or housing 100, a lid 102, and a base 104. The body 100 can be a suitably sized cylinder to house the roller pad 204 and/or brush to be cleaned therein. The lid 102 preferably engages the main housing 100 in a secure, sealed relationship to prevent water and paint from leaking out the opening in the top of the housing 100.

As shown in FIG. 1, the rod 202 of the paint roller 200 is preferably clipped or fastened onto the main housing 100 using a clip 116 (or other suitable connection mechanism) such that the roller pad 204 is arranged within the main housing 100 and is capable of rotational movement within the housing 100. Alternatively, a paintbrush (not shown) can be fastened into to a paintbrush adapter (not shown) arranged in the rod connection mechanism (clip) 116 or into a paintbrush connection mechanism 118 arranged in the lid 102. The paintbrush is also preferably arranged such that it is capable of rotational movement within the housing 100.

FIG. 1 also displays a bottom or base 104 of the apparatus having a hole 106 and legs 108. The hole 106 preferably allows water (or other cleaning solution) and paint to be dispensed out of the main body 100 as the roller pad 200 or paintbrush (not shown) is being cleaned. The legs 108 allow the apparatus to be positioned above the supporting surface that the apparatus 10 is being used on, thereby providing stability and allowing the cleaning solution and paint to be drained more easily. A hose attachment 110 allows the user to attach a water supply hose 112 to the apparatus. The hose attachment 110 is preferably attached to the main housing 100 of the apparatus 10. A valve 114 can also be provided to permit the supply of water to the cleaning apparatus 10 to be turned on or off and/or to permit the volume of water (and hence the water pressure) supplied to the cleaning apparatus 10 to be controlled.

A stem 140 preferably connects to the hose attachment 110 and extends longitudinally through a portion of the main housing 100. The stem 140 can include one or a plurality of spray nozzles 142 (see FIG. 4) that are arranged to supply the water or other cleaning solution to the roller pad 204 or paintbrush. The spray nozzles 142 are preferably arranged to impart a rotational movement to the roller pad 204 or paintbrush (not shown) during operation of the cleaning apparatus 10 to aid in the cleaning process.

Figure 2:
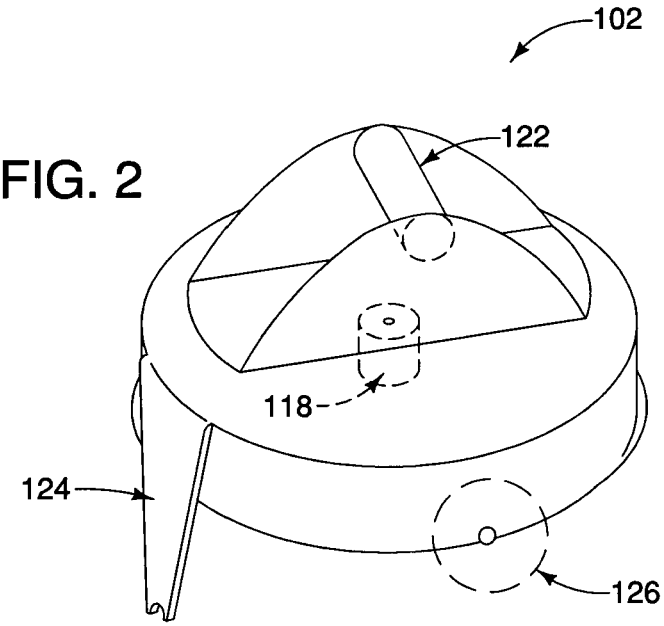
FIG. 2 is a somewhat schematic view of a lid for the cleaning apparatus of FIG. 1, further including a cradle/clip mechanism.
Figure 2A:
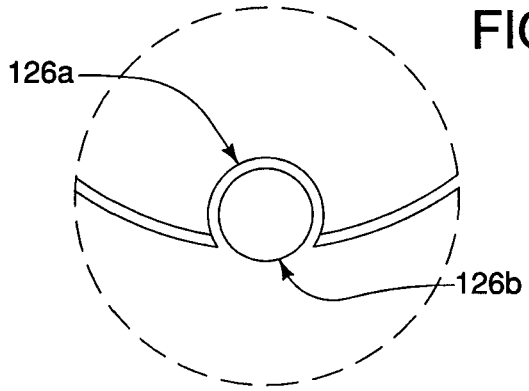
FIG. 2A is an exploded view of the connection mechanism for connecting the lid of FIG. 2 to the main housing of FIG. 1.

FIG. 2 is a somewhat schematic perspective view of the lid 102 of the cleaning apparatus 10 of FIG. 1. FIG. 2A provides a more detailed exploded view of a connection mechanism 126 for connecting the lid 102 to the housing 100. Referring additionally to FIGS. 2 and 2A, the lid 102 of the cleaning apparatus 10 can provide numerous features and functions. The lid 102 can, for instance, include a handle 122 to provide an easy mechanism for removing the lid 102 and transporting the cleaning apparatus 10. The lid 102 can also include an extension or protrusion 124 for covering the cradle/clip mechanism 116, and thereby help to seal the main housing 100 and reduce or prevent leaks. An attachment mechanism 126 can also be provided in the lid 102 for securely connecting to the housing cylinder 100. A paintbrush cleaning attachment 118 may also be provided in the lid 102 to enable cleaning of paintbrushes. The lid 102 preferably seals with the main housing 100 to contain the water and paint during operation of the cleaning apparatus 10.

The handle 122 can be part of lid 102 to provide easy portability of the apparatus 10. The extension/protusion 124 can seal off the cradle/clip mechanism 116 (see FIG. 1) and prevent water seepage. The protrusion 124 can also act as a stabilizer for helping secure the roller bar 202 in the cradle/clip mechanism 116.

Referring now specifically to FIG. 2A, the attachment mechanism 126 can, for instance, have two parts. A female opening 126*a* can be a part of the lid 102 and receive a male stub 126*b* attached to the cylinder 100 (see FIG. 1). This (or any other suitable connection mechanism) can be used to allow the lid 102 and the main housing 100 to be securely connected together and function as one unit during operation of the cleaning apparatus 10.

The optional paintbrush cleaning attachment 118 is preferably configured to be able to receive a variety of different sizes of paintbrushes and to facilitate paintbrush cleaning in the apparatus 10. During operation, a paintbrush can be arranged having its handle positioned in the paintbrush connection mechanism 118. Water pressure supplied from the stem 140 through the nozzles 142 then preferably spins and washes the paintbrush clean. The paintbrush attachment 118 preferably includes internal bearings that allow the paintbrush to spin with respect to the housing 100.

The roller brush connection mechanism 116 is shown in further detail in FIGS. 3-3B. Referring additionally to FIGS. 3, 3A and 3B, the roller brush connection mechanism 116 of the cleaning apparatus 10 can include in two parts, a cradle 115 and a clip 116. As shown, openings of various diameters can be provided in one or both of the cradle and clip mechanisms 115, 116 to secure roller bars of different sizes. The clip 116 and the cradle 115 preferably receive different parts of the roller bar 202 and secure the bar 202 in place through a friction or press fit relationship. These connections also provide stability as the roller pad 204 receives a high pressure water stream(s) from the spray nozzle(s) 142 on the stem 140.

FIGS. 4A-4C further illustrate the stem/spraying mechanism 140. Referring now additionally to FIGS. 4A-4C, the stem/spraying mechanism 140 receives water from the water supply hose 112 and forces the water through the spray tips (or nozzles) 142. In a preferred embodiment, each spray tip 142 can be made of polypropylene and have an opening size encoded "80-15R." This code represents the size of the spray opening and therefore the amount of water that can be dispersed from that opening.

Regardless of the material used or the size of the spray openings, the water pressure supplied from the spray nozzles 142 preferably both washes the roller pad or paintbrush and causes it to spin clean. As further illustrated, the plurality of spray nozzles 142*a-d* are preferably arranged in a spaced-apart relationship from each other with each nozzle having a different orientation with respect to the stem 140, so that a spray direction 143*a-d* of each of the spray nozzles is different.

More particularly, the configuration and arrangement of the spray openings from the nozzles 142*a-d* can be configured to create a water fan that sprays an equal amount of water consistently over the span of the roller pad 204 or brush (not shown). In addition, by providing a different spray angle $\alpha_{a-d}$ for each of the spray nozzles 142*a-d* with respect to the roller pad 204 or paintbrush arranged in the main housing 100, a better spin and therefore better cleaning of the pad/brush can be obtained. In other words, by configuring the stem 140 with one or more spray tips 142 being slightly offset from each other with respect to a spray direction in relation to the surface of the roller pad being cleaned, this can force a better rotation of the roller pad/paintbrush and provide better cleaning.

As will be readily apparent from the foregoing description, many variations in details and configurations are possible and should be considered within the spirit and scope of the present invention. Among other things, according to other features or embodiments of the present invention, a hands-free cleaning apparatus 10 can include a hose 112, which comes as a separate attachment with the cleaning apparatus 10. The hose 112 can allow operation of the apparatus 10 either indoors or outdoors. A valve 114 can be attached to the hose connection mechanism 110 or part of the hose 112 to allow the user to control the amount of water pressure being supplied to the cleaning apparatus 10 and therefore being dispersed through the spraying mechanism 140.

Of course, other arrangements and configurations are also possible. For instance, the entire apparatus can be composed from any of a variety of desired plastics, selected, for instance, based on the properties of the plastic, its cost, and other considerations. In addition, the housing 100 can be any desired shape or size and can further be transparent to enable the user to view the progress of cleaning process.

Having described and illustrated the principles of the invention in various embodiments thereof, it should be apparent that the invention could be modified in arrangement and detail without departing from such principles. All such modifications and variations therefore fall within the spirit and scope of the present invention.

What is claimed is:

1. A cleaning apparatus for cleaning painting implements, comprising:

a main housing configured to receive the painting implement within the housing;

an attachment mechanism for securing the painting implement in a cleaning position with respect to the main housing; and a plurality of spray nozzles arranged within the main housing and directed generally toward and configured to supply water to the painting implement to clean the painting implement when the painting implement is located within the housing, wherein the plurality of spray nozzles comprises at least three spray nozzles arranged having at least three different spray angles.

2. A cleaning apparatus according to claim 1, further comprising:

a lid configured to be arranged over an opening in a top of the main housing;

wherein the attachment mechanism comprises a clip arranged along the main housing, said clip configured to receive a handle of a roller brush and retain the handle in position with respect to the housing; and wherein the lid comprises a receptacle configured to further retain a handle of a roller brush in position with respect to the housing.

3. A cleaning apparatus according to claim 1, wherein the attachment mechanism comprises a paintbrush attachment configured to secure a paintbrush to a lid of the cleaning apparatus in a rotatable relationship.

4. A cleaning apparatus according to claim 1, further comprising a base configured to support the main housing on a supporting surface, wherein the base comprises a drainage opening to permit water and paint to drain from the main housing.

5. A cleaning apparatus according to claim 4, wherein the base further comprises a plurality of legs to support the main body a predetermined distance above the supporting surface.

6. A cleaning apparatus according to claim 1, wherein the attachment mechanism comprises a clip configured to receive and retain a bar of a roller brush in a desired position with respect to the main housing of the cleaning apparatus, such that a roller pad of the roller brush is arranged within the main housing in a rotatable relationship.

7. A cleaning apparatus according to claim 6, wherein the clip mechanism comprises a plurality of differently sized receptacles configured to securely receive and retain handles of different sizes within the clip mechanism.

8. A cleaning apparatus according to claim 1, wherein the plurality of spray nozzles are arranged on a stem that extends substantially longitudinally through at least a portion of the main housing.

9. A cleaning apparatus according to claim 1, wherein the main housing comprises a substantially transparent body.

10. A cleaning apparatus for cleaning painting implements, said cleaning apparatus comprising:

a main housing configured to receive a painting implement therein;

a retaining mechanism configured to receive and hold a handle of the painting implement in place with respect to the main housing;

a base configured to support the main housing a predetermined distance above a supporting surface;

a lid configured to cover a top opening in the main housing during operation of the cleaning apparatus, and further configured to assist the retaining mechanism in holding a handle of the painting implement in place with respect to the main housing; and a spray mechanism configured to receive a supply of water and comprising a plurality of spray nozzles, each spray nozzle configured to supply a stream of water from the water supply to the painting implement to clean the painting implement, wherein the plurality of spray nozzles comprises at least three spray nozzles and wherein each of the spray nozzles is configured with a different spray angle than each of the other spray nozzles.

11. A cleaning apparatus according to claim 10, wherein the lid is configured to attach to the main body in a sealing relationship to prevent water and paint from escaping through the top opening during operation of the cleaning apparatus, and wherein the lid further comprises a receptacle for receiving a handle of the painting implement and helping to secure the painting implement in place with respect to the main housing, and a handle for carrying and transporting the cleaning apparatus.

12. A cleaning apparatus according to claim 10, wherein the retaining mechanism comprises a clip arranged on the main housing, said clip having one or more openings configured to receive a bar of a roller brush in a friction-fit relationship.

13. A cleaning apparatus according to claim 12, wherein the clip opening comprises a plurality of differently-sized openings configured to receive and retain roller brush bars of different sizes.

14. A cleaning apparatus according to claim 10, wherein the retaining mechanism comprises a paintbrush attachment configured to receive and retain a handle of a paintbrush such that the paintbrush is capable of rotation about a longitudinal axis.

15. A cleaning apparatus according to claim 10, wherein the main housing is substantially transparent.

16. A cleaning apparatus for a painting implement, said cleaning apparatus comprising:

a main housing configured to receive a painting implement with the brush or pad arranged in a rotatable relationship with respect to the main housing; and a spray mechanism comprising a stem arranged longitudinally in the main housing, and a plurality of spray nozzles arranged along the stem and each configured to spray a cleaning solution onto the brush or pad of the painting implement and to cause rotation of the brush or pad of the painting implement with respect to the main housing, wherein the plurality of spray nozzles comprises at least three spray nozzles that are configured with at least three different spray angles.

17. A cleaning apparatus according to claim 16, wherein the main housing is substantially transparent.

* * * * *